US005120262A

United States Patent [19]

Caine

[11] Patent Number: 5,120,262

[45] Date of Patent: Jun. 9, 1992

[54] DOLL HOUSE WITH STORAGE COMPARTMENT

[76] Inventor: Rodney L. Caine, 7927 Marshall St., Arvada, Colo. 80003

[21] Appl. No.: 478,613

[22] Filed: Feb. 12, 1990

[51] Int. Cl.[5] ..... A63H 3/53

[52] U.S. Cl. ..... 446/476; 446/75

[58] Field of Search ..... 446/75, 76, 73, 476, 446/478, 110, 477

[56] References Cited

U.S. PATENT DOCUMENTS

| | | | |
|---|---|---|---|
| 1,428,405 | 9/1922 | Wegener | 446/478 |
| 1,517,030 | 11/1924 | Talcott | 446/75 |
| 1,641,209 | 9/1927 | Wallace | 446/476 |
| 4,067,137 | 1/1978 | Korthase | 446/478 |
| 4,070,789 | 1/1978 | Levenson | 446/478 |

*Primary Examiner*—Mickey Yu

*Attorney, Agent, or Firm*—Timothy J. Martin; Dana S. Rewoldt

[57] ABSTRACT

A doll house for use as a play and storage area for dolls and accessories has an exterior shell rigidly constructed as a modular unit with a pair of end walls, a side wall and a lower floor panel to define an interior with an open front. A ceiling panel is parallel to the floor panel and extends forwardly of the side wall. The ceiling panel is below the upper edges of the end walls to form end wall expanses, and a roof panel is rigidly mounted to extend between the expanses. A lid panel is hinged along a hinged edge of the roof panel and has a free edge opposite the hinged edge so that the expanses, the roof panel and the lid panel enclose a storage area. The lid panel may be opened to access the storage area. When closed, the free edge of the lid panel is proximate the front edge of the ceiling panel.

23 Claims, 4 Drawing Sheets

DOLL HOUSE WITH STORAGE COMPARTMENT

FIELD OF THE INVENTION

The present invention broadly relates to children's playhouses, but specifically to miniature dwelling formats which may be utilized as an interactive play area in conjunction with dolls. The present invention specifically relates to a doll house construction which not only provides a multi-roomed play area, but which also has a combination storage compartment and play area which may be used as a staging area for dolls but which may also be used to store dolls and accessories in-between intervals of play.

BACKGROUND OF THE INVENTION

The existence of dolls dates to pre-recorded history of human kind. Since these early times, dolls have enjoyed a unique place in human development not only as play objects but also as item of religious significance and healing. Even in modern times, the value of dolls both for recreational activity and for the physiological application in diagnosis and therapy is widespread. Virtually every culture in every part of the world realizes some benefits from dolls.

With respect to the utilization of dolls as objects of play, their significance can not be over stated. Indeed, a substantial portion of the toy industry is founded on the provision of various dolls having differing attributes and in the provision of accessories for those dolls. Further, in order to create a realistic environment for play, various doll houses have been proposed in order to provide a simulated living environment which stimulates the imagination, especially of children. Thus, implementation of doll houses provides a realistic setting for play wherein a child may act out, through the doll media, everyday situations.

Notwithstanding the existence of doll houses as a staging arena for the make believe, a problem remains when play time is over. Due to the various accessory items, such as articles of clothing and the miniature "possessions", concomitant with dolls, it is not uncommon for doll play and doll houses to have associated therewith substantial clutter and disarray. Thus, doll houses often exhibit an untidy appearance despite good intentions of adults and children. Common practice allows for storage of dolls and accessory items in special places such as drawers, boxes, toychests and the like. In many instances, though, such storage areas are somewhat inconvenient, especially for children. Accordingly, there has been a long felt need for a doll house which provides greater convenience for play with and storage of dolls and accessories. It is not believed that heretofore, this need has been adequately satisfied, and it is to this need that the present inventor directs his improvements to existing doll house technology.

SUMMARY OF THE INVENTION

It is an object of the present invention to provide a new and useful doll house construction that not only provides a staging area for doll play as opposed to gun play but also provides a self-contained storage compartment for dolls and their accessories.

Another object of the present invention is to provide a doll house which may be enclosed when not in use so as to present an uncluttered and tidy appearance.

Yet another object of the present invention is to provide a doll house structure that is relatively inexpensive to produce so that ownership is available to a substantial majority of families.

Still another object of the present invention is the provision of a that has a self-contained storage compartment which may also function as an additional play area or room in the doll house.

Another object of the present invention is to provide a doll house having foldable sections allowing the doll house to expand into a larger play area yet collapse into a smaller storage area that also acts to store dolls and accessories.

According to the present invention, then, a doll house structure is provided which structure is adapted to set on a support surface and provides both a play area for children's dolls and accessories in a concealed storage area for storing the dolls and accessories when not in use. The doll house structure broadly includes an exterior house shell that has an interior with an open front and which is formed by a sidewall panel having an upper side edge, a pair of opposite endwall panels having respective upper endwall edges and a lower floor panel. A ceiling panel extends between the endwalls parallel to the floor panel and forwardly of the sidewall so that the ceiling panel is positioned below the respective upper endwall edges to separate the endwalls into an upper endwall expanse and a lower endwall expanse. A first roof panel is mounted on the house shell between the upper endwall expanses and a lid panel extends between the upper endwall expanses so that the roof panel, the lid panel, and the upper endwall expanses form an enclosed storage region sized to receive and store dolls and accessories. The lid panel is hingedly secured to the roof panel and is movable between a closed position wherein the storage region is concealed and an open position wherein the storage region is accessible. Thus, when the lid panel is in the open position, the storage region becomes an attic play area for the doll house.

Preferably, each of the upper endwall expanses is triangular in configuration with the ceiling panel oriented along the respective bases thereof. The roof panel then lays along the one side of the triangular configuration and the lid panel extends along a respective second side of the triangular configuration. These triangular configurations of the upper endwall expanses may be a right angle with the roof panel being oriented along the respective hypotenuse thereof. Alternately, the upper endwall expanses may have an isosceles triangular configuration with the roof and lid panels oriented along the respective leg edges of the isosceles triangular configuration. A rail element may be mounted proximate a front edge of the ceiling panel in order to form an upstanding rail in the front of the house shell and the storage region which upstanding rail is operative to help retain the dolls and the accessories in the attic play area and also to define a seat for the lid panel when it is in the closed position.

Further, the doll house according to the present invention may include an intermediate floor panel positioned between and parallel to the floor and ceiling panels to separate the interior of the house shell into upper and lower levels, and an interior wall panel may extend between the floor and intermediate floor panels outwardly from the sidewall toward the front of the house shell thereby to separate the lower level into two room portions. The open front of the doll house may be enclosed by doors which pivot between door open and door closed positions along pivot axes proximate each respective endwall. The interior wall panel may have a doorway opening therein. If desired, the floor panels as well as an upper surface of the ceiling panel, in the attic play area, may be covered with a felt material to simulate carpeting. A deck structure may be pivotally mounted on one or more of the end panels on an exterior of the exterior shell, with this deck structure movable between a stored position against a respective endwall panel and an operative position parallel to the support surface. Deck railing may be provided around a deck floor that forms the deck structure, with the deck railings foldable with respect to the deck floor. One or more support legs may be pivotally mounted to the underside of the deck floor to support the deck floor when in the operative position.

The exterior house shell may be strengthened by a reinforcement column along each endwall panel along the front and wall edge thereof, the door panels may include a latch structure, such as a key lock, for fastening the door panels in a closed position, and the latch means may be key actuated. The lid panel, as well as the roof panel, may be provided with skylight openings and door and window openings may be provided in the endwalls, in the sidewall and in the door panels, as desired.

Further, according to one form of the present invention, the doll house structure may be formed by a pair of house sections which are pivotal to one another to be movable between an open house position exposing the respective interiors of each house section and a closed house position enclosing the respective interior. Each of these house sections include the exterior house shell, the respective roof panels and the respective lid panels similar to that described above.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
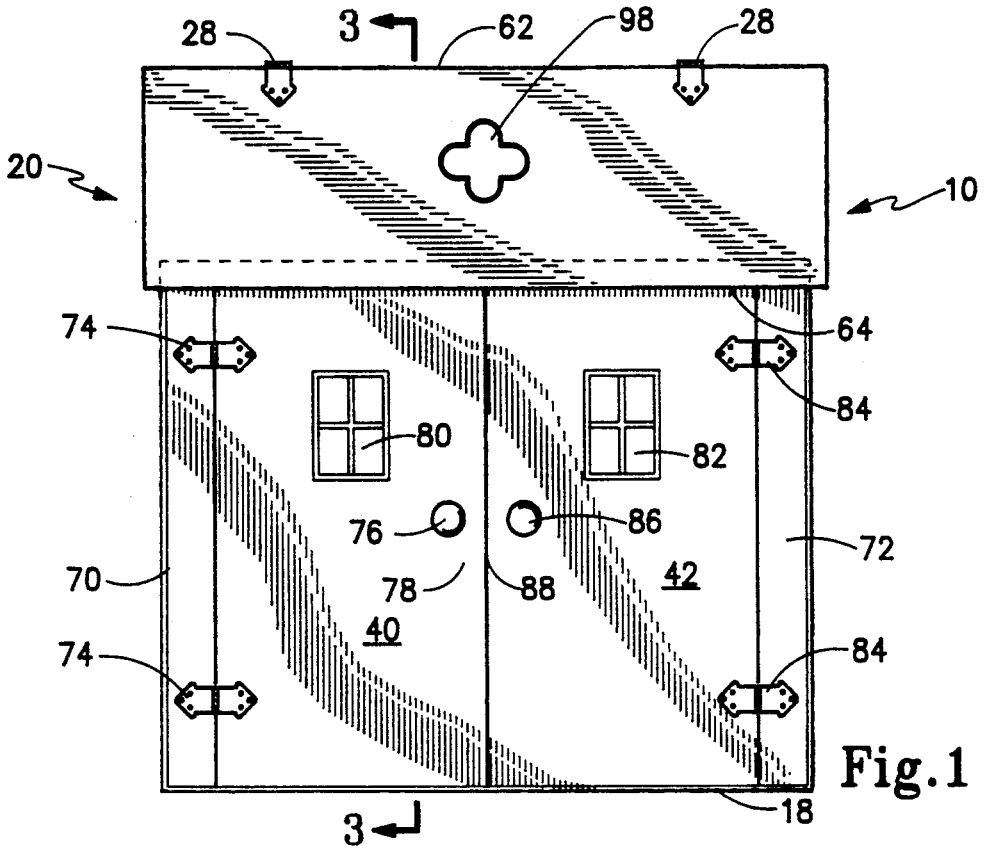
FIG. 1 is a front view in elevation showing a doll house according to a preferred embodiment of the present invention.

The present invention broadly relates to playhouses, but particularly to doll houses which form a play area to be used be children when playing with dolls and their accessories. As noted above, the present invention is specifically directed to a new and useful doll house structure that provides a concealed storage area that performs as an attic play area when it is not being used for storage. Further, the preferred embodiment of the present invention contemplates a doll house that may have its interior completely enclosed, and which has an auxillary storage area, so that the doll house, the dolls and the doll accessories are maintained in a neat and tidy manner.

As may be best shown in FIGS. 1–4, the basic construction of the doll house 10 according to the preferred embodiment of the present invention is formed by an outer house shell which may be defined to include a sidewall 12, a first endwall 14, a second endwall 16 and a floor panel 18. A roof structure 20 forms a top for the housing shell and includes a ceiling panel 22 which extends between endwall Panels 14 and 16 in spaced apart parallel relation to floor panel 18. In this manner, ceiling panel 22 may be seen to separate first end panel 14 into a lower end panel expanse 30 and a triangularly shaped upper end panel expanse 32. Similarly, ceiling panel 22 separates second end panel 16 into a lower end panel expanse 34 and a triangularly shaped upper end panel expanse 36. Roof structure 20 has a stationary roof panel 24 and a movable lid panel 26 which is pivotally secured to a forward edge of roof panel 24 by means of hinges 28.

Figure 2:
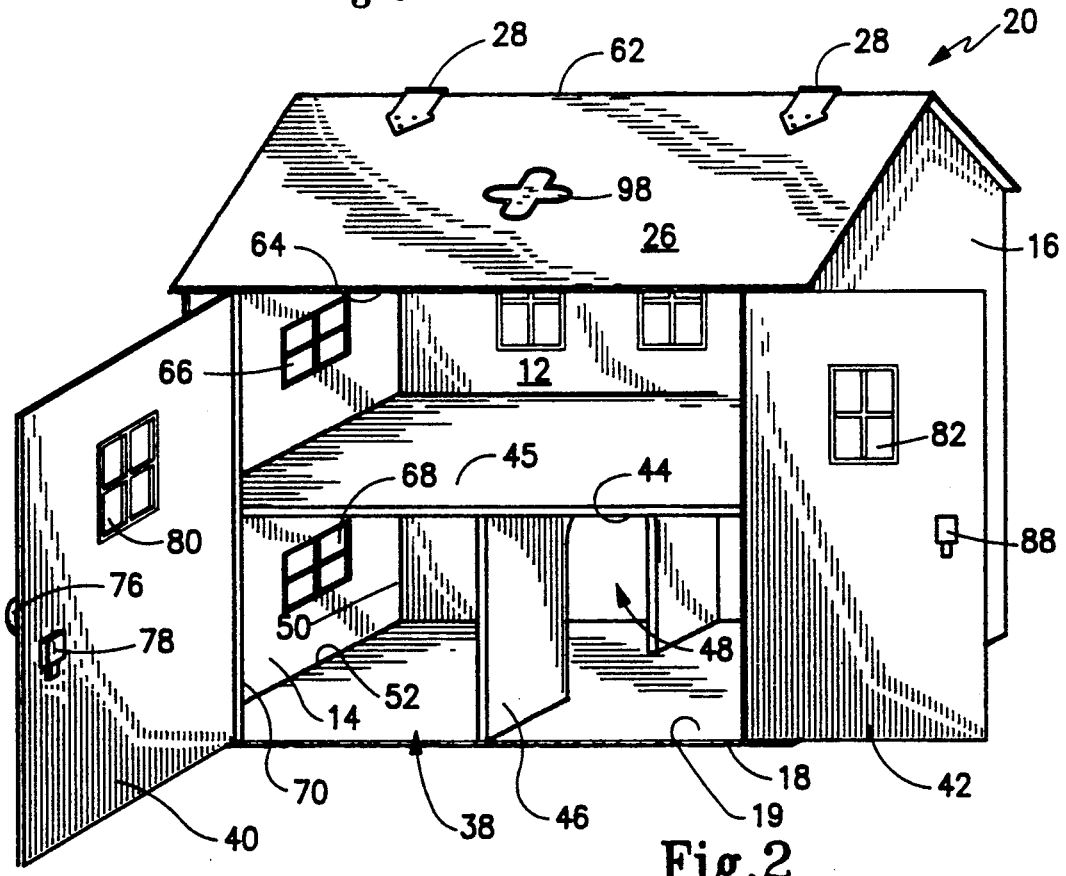
FIG. 2 is a perspective view showing the doll house of FIG. 1 with the door panels in an open door position.
Figure 3:
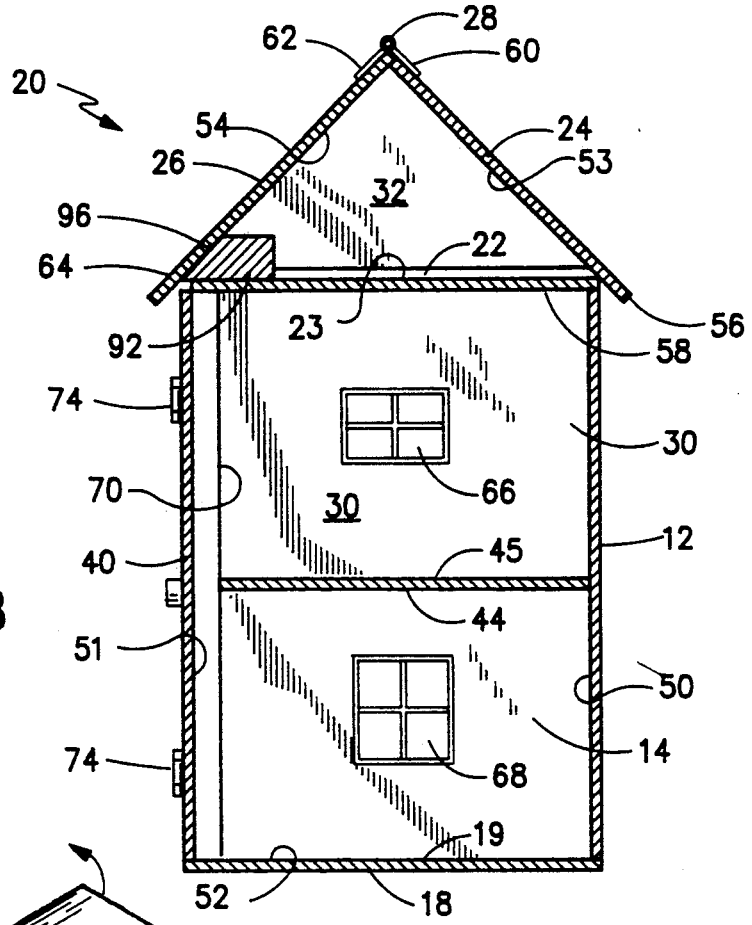
FIG. 3 is a cross-sectional view taken about lines 3—3 of FIG. 1.

As is seen in FIG. 2, the housing shell has an open front 38 which may be selectively closed by means of a pair of door panels 40 and 42 which may be moved between a door closed position, such as that shown in FIGS. 1 and 3 to a door open position shown in FIG. 2. An intermediate floor panel 44 may extend between end panels 14 and 16 in equidistantly spaced parallel relation thereto, and an interior wall panel 46, having a doorway opening 48, may extend upwardly between floor panel 18 and intermediate floor panel 44 in parallel relation to end panels 14 and 16 and intermediate thereof. Accordingly, intermediate floor panel 44 separates the interior of the exterior shell of doll house 10 into upper and lower floor levels while inner wall 46 separates the lower level into a pair of rooms. Thus, in effect, the lower level has a pair of rooms each bounded by floor panel 18 intermediate panel 44 inner wall 46 and a respective endwall panel 14 and 16, which each of these two lower rooms being internally accessible to one another through doorway 48. The upper level is in the form of one large upper room bounded by ceiling panel 22, intermediate floor panel 44 and endwall panels 14 and 16.

Each of end panels 14 and 16 are constructed similarly, so, for purposes of greater specificity a description of one of these endwall panels, such as endwall panel 14, may be representative of this common construction For greater specificity, then, as is seen in FIG. 3, endwall panel 14 has a rear edge 50 which extends along sidewall panel 12 and a front edge 51 which extends along door panel 40 in spaced apart parallel relation to edge 50. End panel 30 has a bottom edge 52 which extends along floor panel 18 between rear edge 50 and front edge 51. End panel 30 has a top edge including a rearward top edge portion 53 and a forward top edge portion 54 which define the leg portions of triangular upper endwall expanse 32. It may thus be appreciated that stationary roof panel 24 extends between and is supported by the respective rearward upper edge portion 53 of the respective end panel 14, 16 while lid panel 26 rests on and is supported by forward upper edge portions 54 of the respective end panels 14 and 16. Thus, roof panel 24 has a rearward edge 56 which extends behind and slightly below an upper side Panel edge 58 of side panel 50 and has a roof panel forward edge 60 at an apex of roof structure 20. Lid panel 26 has a rearward edge 62 which is hingedly secured to forward edge 60 of roof panel 24 by hinges 28. Lid panel 26 has a forward edge 64 opposite rearward edge 62.

End panel 14 has upper and lower window openings 66 and 68. As is shown in FIGS. 1–4, reinforcement columns 70 and 72 extend between floor panel 18 and ceiling panel 22. Door panel 40 is hingedly secured to support column 70 by means of hinges 74. Door panel 40 includes a handle in the form of knob 76 and a key actuated latch mechanism 78 as is well known in the art. Further, door panel 40 includes a window opening 80 centrally located on an upper portion thereof. Door panel 42 is of a similar construction and is attached to column 72 by means of hinges 84. Door panel 42 has a handle or knob 86 and a key latch structure 88 as well as a window opening 82 formed at an upper central portion of door panel 42.

Figure 4:
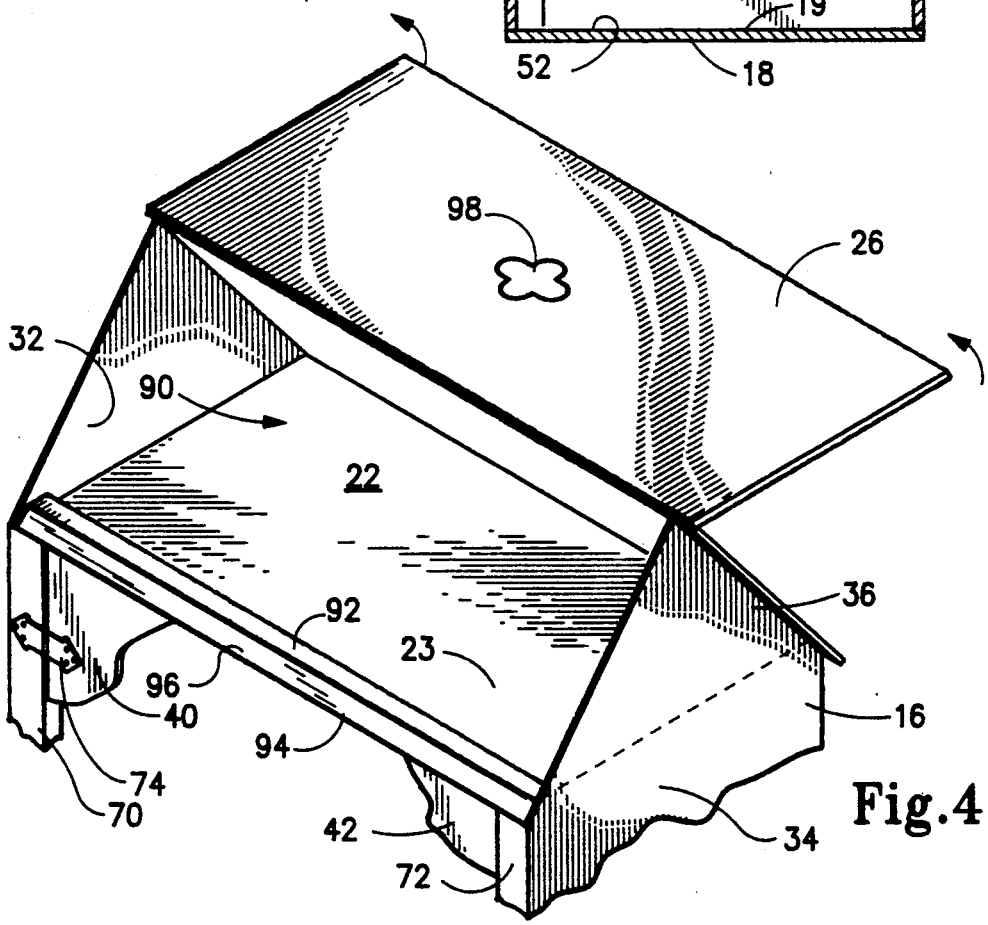
FIG. 4 is a top view of the roof portion of the doll house according to FIG. 1 shown in perspective with the lid panel in an open position.

The construction of roof structure 20 may be best seen with respect to FIGS. 3 and 4, where it may be appreciated that roof structure 20 has an interior defined by an attic region 90 bounded by ceiling panel 22, upper endwall expanses 32 and 36, roof panel 24 and lid panel 26. Attic interior 90 defines both a storage compartment when lid 26 is closed, as is shown in FIG. 3, and an attic play area for the dolls and accessories when lid 26 is in the open position, such as shown in FIG. 4. To this end, ceiling panel 22 includes a fabric covering 23, such as a felt material, simulates carpeting for attic region 90. Similarly, floor panel 18 may have a felt covering 19, and intermediate floor panel 44 may have a felt covering 45, each to simulate carpeting.

A railing 92 extends along a forward edge 94 of ceiling panel 22 and has an angled face 96 that forms a seat for lid panel 26 when lid panel 26 is in the closed position. Lid panel 26 may be provided with a skylight opening 98, if desired. It may be seen that edge 64 of lid panel 26 extends to a location along front edge 94 and does not overhang ceiling panel 22. This allows doors 40 and 42 to be opened and closed regardless of the open or closed position of lid panel 26.

In the construction of doll house 10, it is preferred that a side panel 12 be constructed from ¼" Indonesian plywood with end panels 14 and 16 being constructed out of ⅜" plywood, for rigidity. To this end also, columns 70 and 72 are formed of 1"×2" length of wood fastened to end panels 14 and 16 in any convenient manner, such as glue and nail. Each of floor panel 18 intermediate floor panel 44 and ceiling panel 22 are formed of ¼" plywood, and doors 40 and 42 are preferably formed of ¼" plywood. Stationary roof panel 24 may be formed out of a ⅜" piece of plywood while lid panel 26 is formed out of ¼" plywood. Rail 92 is formed out of a 1"×2" length of wood with face 96 being formed at an angle that corresponds to the angle of edge portion 54 of end panel 14 with respect to ceiling panel 22. These various pieces are secured together in any manner known in the art, such as by hot glue and brad nails. Naturally, construction modification as known in the art is contemplated within the scope of this invention.

Figure 5:
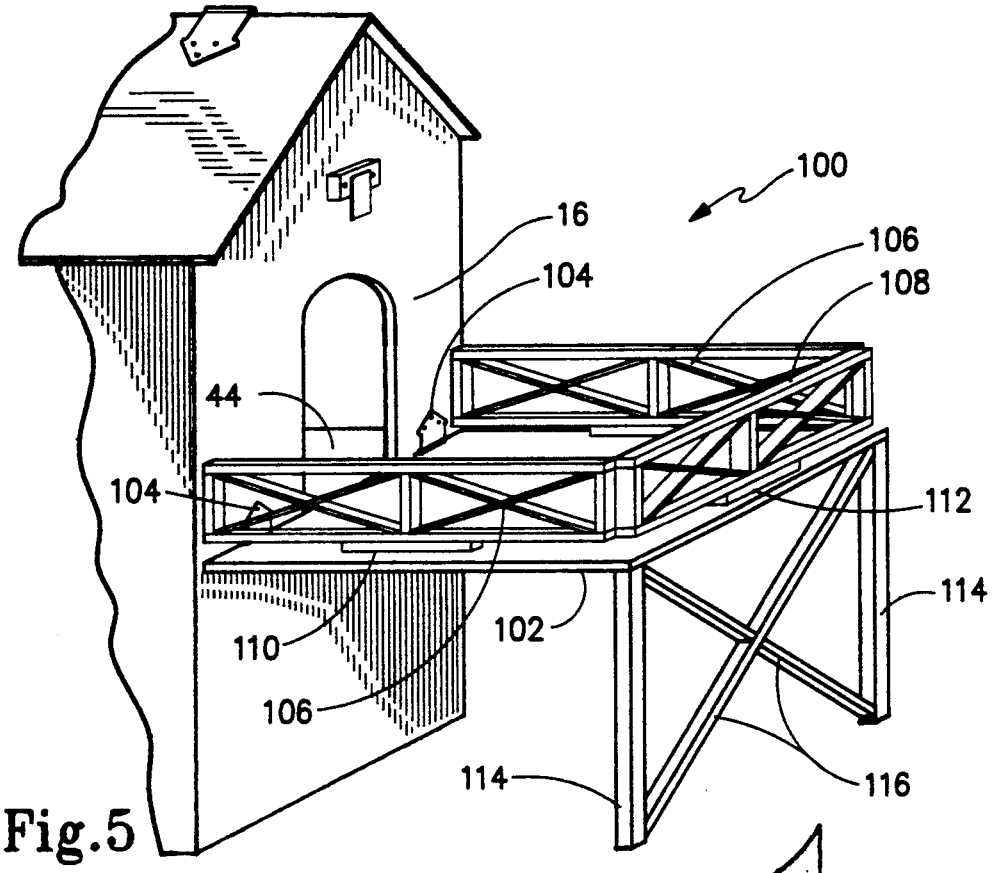
FIG. 5 is a perspective of one endwall of the doll house according to the present invention shown with an auxiliary deck panel.
Figure 6:
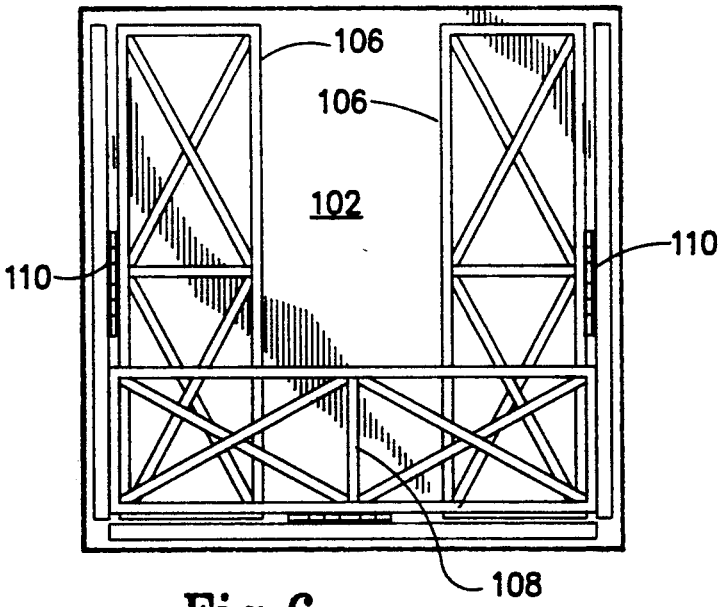
FIG. 6 is a top plan view of the auxiliary deck shown in FIG. 5 shown with the deck railings in a folded configuration.
Figure 7:
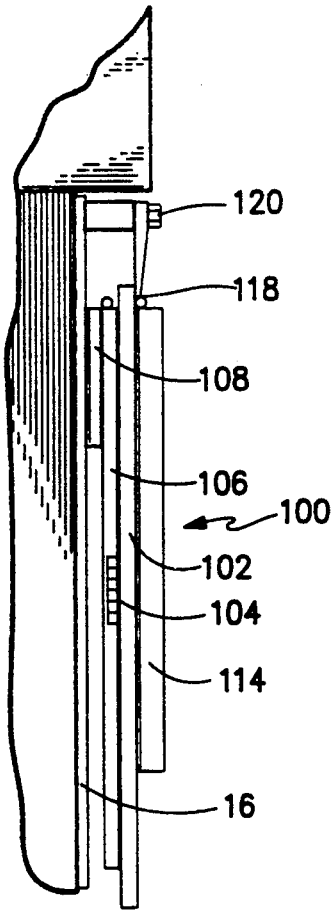
FIG. 7 is a front view, broken away, showing one end of the house structure according to the present invention with the deck panel in a stored position.

If desired, an auxillary deck structure may be provided for doll house 10, as is best shown in FIG. 5–7. Here it may be seen that deck structure 100 has a deck floor 102 that is hingedly secured to end panel 16 by means of hinges 104. A plurality of deck railings, including side railings 106 and end railing 108 are pivotally attached to deck floor 102, for example, by hinges 110 and 112. Thus, as is shown in FIG. 6, side railings 106 may be folded against deck floor 102 and end railing 108 may be folded against railings 106. Deck floor 102 is support against a support surface by means of legs 114 that are cross braced by braces 116. Braces 116 and legs 114 are hingedly secured to deck floor 102 by means of hinges 118. Thus, after railings 106 108 are folded against deck floor 102 deck structure 100 may be folded upwardly against end panel 16, as is shown in FIG. 7 and latched thereto by means of releasable latch structure 120. This deck structure provides an additional doll play area and defines a carport structure for a doll vehicle. To this end, where deck structure 100 is provided, end panel 16 may include an optional deck doorway 101 that allows access between the upper level of the doll house and the deck. Thus, it may be seen that the deck floor is co-planar with intermediate floor 44 when the deck structure 100 is in the unfolded position shown in FIG. 5. Again, deck structure 100 may be fabricated of any suitable materials such as wood or plastic.

Figure 8:
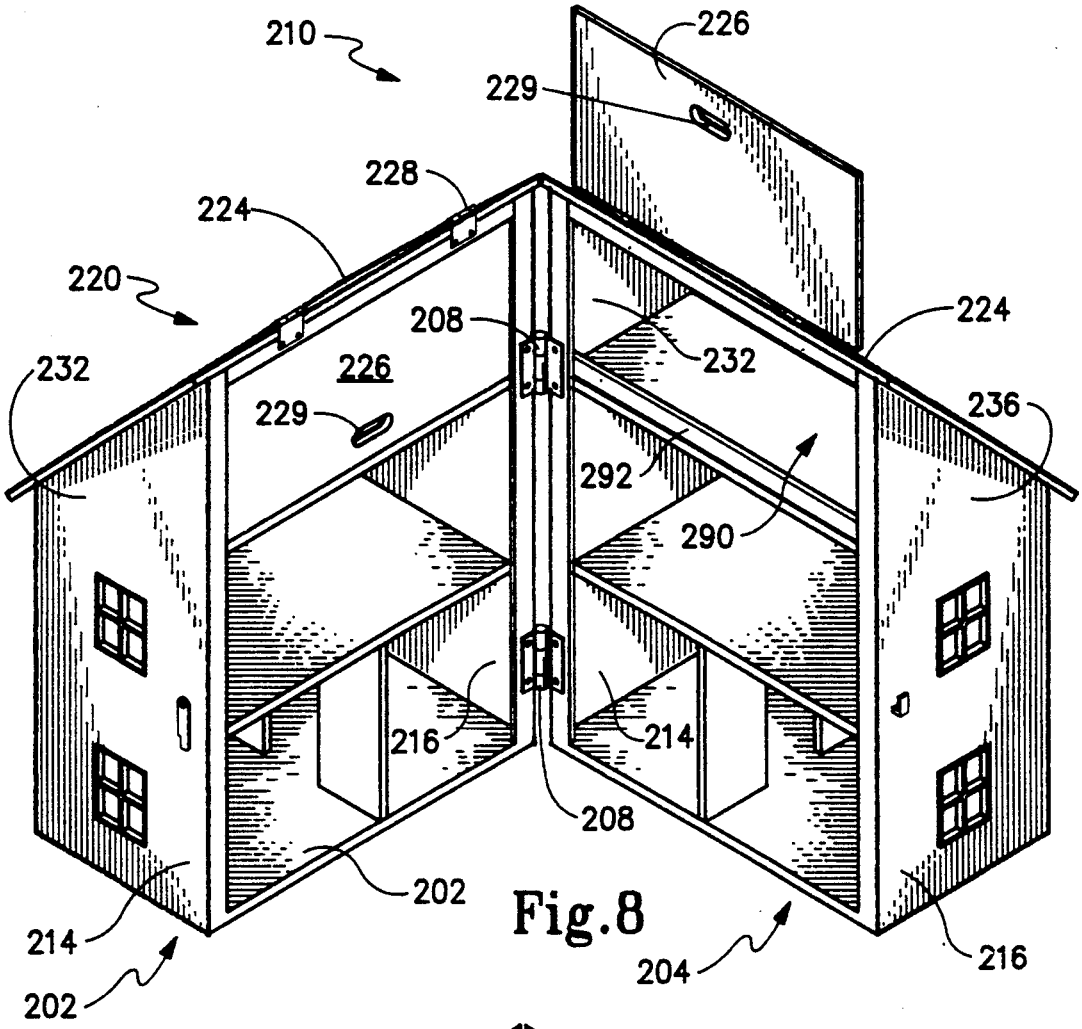
FIG. 8 is an alternate embodiment of the present invention utilizing two house sections, with this alternate embodiment shown in perspective.
Figure 9:
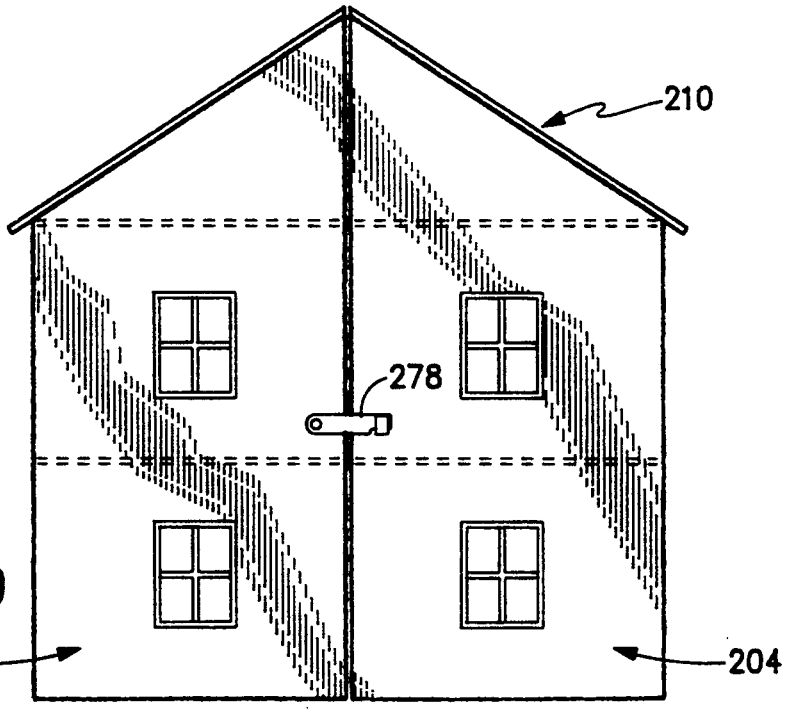
FIG. 9 is an end view in elevation showing the alternate embodiment of FIG. 8 in a house closed position.

An alternate embodiment of the present invention is shown in FIG. 8 and 9. In these figures, doll house 210 includes a pair of doll house sections 202 and 204 which are hingedly secured to one another by means of hinges 208. The construction of each of house sections 202 and 204 is similar to the construction of doll house 10 with the exception of the roof structure 220. Here, the end panels, such as end panels 214 and 216 have respective upper expanses 232 which are formed as right triangles instead of the isosceles triangles shown for expanses 232 and 236 in FIG. 4. Stationary roof panel 224 extends along the hypotenuse of the right triangular expanse 232, 236 with each movable lid panel 226, when in the closed position, being vertically oriented. To enable lid panels 226 to be manually pivoted on their respective hinges 228, openings 229 are formed therein. Each of lid panels 226 seat against a respective railings 292.

As can be seen in FIGS. 8 and 9, house sections 202 and 204 may be pivoted between a house open position, shown in FIG. 8, and a house closed configuration, shown in FIG. 9. House sections 202 and 204 may be latched into the closed position by means of any convenient latch structure such as latch structure 278, known in the art. In use, when in the open position, roof structures 220 provide an auxillary play area in the form of attic regions 290 with these attic regions providing a convenient place for storage of dolls and accessories. Thus, when play is finished, dolls and accessories may be placed in the attic region 290 and lid panels 226 moved to the closed position. House sections 202 and 204 may then be pivoted in to the closed position and latched so that the doll house 10 presents a pleasing and neat appearance.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A doll house structure adapted to set on a support surface and to provide both a play area for children's dolls and accessories and a concealed storage area for storing the dolls and accessories when not in use which concealed storage area can also function as an additional doll play area, comprising:

an exterior house shell rigidly constructed as a modular unit having an interior with an open front, said house shell including a side wall having an upper side edge, a pair of opposite endwalls having respective upper end wall edges and a a lower floor panel;

a ceiling panel extending between said pair of endwalls parallel to said floor panel and forwardly of said side wall to a ceiling panel front edge, said ceiling panel positioned below the respective upper endwall edges of said endwalls to form a pair of endwall expanses;

a first roof panel rigidly mounted on said house shell and extending between said endwall expanses; and a lid panel having a lid panel free edge, said lid panel extending between said endwall expanses so that said roof panel, said lid panel said endwall expanses and said ceiling panel enclose a storage region sized to receive and store dolls and accessories, said lid panel being hingedly secured to said roof panel and movable between a closed position wherein said lid panel free edge is located proximate said ceiling front edge the storage region is concealed and an open position wherein said storage region is accessible.

2. A doll house structure according to claim 1 wherein the storage region defines an attic play area for said doll house when said lid panel is in the open position.

3. A doll house according to claim 1 wherein each of the endwall expanses has a triangular configuration with said ceiling panel oriented along the respective bases thereof, said roof panel being oriented along a respective first side of the triangular configuration and said lid panel being oriented along a respective second side of the triangular configuration.

4. A doll house according to claim 3 wherein each of the triangular configurations is a right triangle with said roof panel oriented along the respective hypotenuse thereof.

5. A doll house according to claim 3 wherein each of the triangular configurations is an isosceles triangle with said roof and lid panels oriented along respective leg edges thereof.

6. A doll house according to claim 1 including a rail element mounted on said ceiling panel proximate a ceiling panel front edge, said rail element forming a upstanding rail at the front of said house shell in the storage region operative to help retain dolls and accessories in the attic play area.

7. A doll house according to claim 6 wherein said rail element defines a seat for said lid panel when said lid panel is in the closed position.

8. A doll house according to claim 1 including an intermediate floor panel positioned between and parallel to said floor and ceiling panels to separate the interior of said house shell into upper and lower levels.

9. A doll house according to claim 8 including an interior wall panel extending between said floor and intermediate floor panels and extending from said sidewall forwardly to the front of said house shell thereby to separate the lower level into two room portions.

10. A doll house according to claim 9 wherein said interior wall panel has a doorway opening formed therein.

11. A doll house according to claim 1 including a fabric covering on an upper surface of said floor panel to simulate carpeting therefor.

12. A doll house according to claim 1 including a deck structure pivotally mounted on one of said endwall panels and movable between a stored position against the respective endwall panel and an operative position parallel to the support surface.

13. A doll house according to claim 12 wherein said deck structure includes a deck floor, deck railings extending at least partially around said deck floor and foldable with respect thereto, and at least one support leg pivotally mounted to said deck floor to support said deck floor when in the operative position.

14. A doll house according to claim 12 including an intermediate floor panel intermediate of and parallel to said floor and ceiling panels, wherein said deck structure is co-planar with said intermediate floor panel in the operative position and wherein said one of said endwall panels has a deck doorway opening formed therein.

15. A doll house structure adapted to provide a play area for children's dolls and to provide a concealed storage area for storing dolls and accessories when not in use which concealed storage area can also function as an additional doll play area, comprising:

an exterior house shell having an interior with an open front, said house shell including a pair of parallel spaced apart endwalls each having respective upper endwall edges, front endwall edges and rear endwall edges, a side wall extending across a back of the house shell between the rear endwall edges of said endwalls, a lower floor panel and an upper ceiling panel extending between said pair of endwalls and forwardly of said side wall in parallel relationship to one another, said ceiling panel positioned below the respective upper endwall edges of said endwalls to form a pair of endwall expanses;

an intermediate floor panel oriented parallel to said floor and ceiling panels and positioned therebetween to separate the interior of said house shell into an upper and a lower floor level;

an interior wall panel extending between said floor and intermediate floor panels and extending from said side wall forwardly to the front of said house shell thereby to separate the lower level into two room portions;

a first roof panel mounted on said house shell and extending between said endwall expanses;

a lid panel extending between said endwall expanses so that said roof panel, said lid panel and said endwall expanses enclose a storage region sized to receive and store dolls and accessories, said lid panel being hingedly secured to said roof panel and movable between a closed position wherein the storage region is concealed and an open position wherein said storage region is accessible so that said storage region defines an attic play area; and door means for enclosing the front of said house shell including a door panel hingedly secured to said house shell along a vertical pivot axis proximate said endwalls and movable between an open door position exposing the interior of said house shell and a closed door position enclosing the interior front.

16. A doll house according to claim 15 wherein said door means includes a pair of complementary door panels, each said door panel hingedly secured to said house shell along respective vertical pivot axes proximate a respective endwall and movable between an open position.

17. A doll house according to claim 15 including a reinforcement column associate with each endwall panel and located along the front endwall edge thereof, said door means including a pair of complementary door panels each hingedly secured to a respective reinforcement column and pivotable between a door open position allowing access to the interior of said house shell and a door closed position operative to enclose the interior.

18. A doll house according to claim 15 including latch means for fastening said door panels in the door closed position.

19. A doll house according to claim 15 including a handle on each of said door panels.

20. A doll house according to claim 15 wherein said endwall panels, said side wall panel and said door panels have window openings formed therein.

21. A doll house according to claim 15 wherein said interior wall panel has a doorway opening formed therein.

22. A doll house according to claim 15 including a fabric covering on an upper surface of at least one of said floor panel, said intermediate floor panel and said ceiling panel to simulate carpeting therefor.

23. A doll house according to claim 15 wherein said lid panel has a skylight opening formed therein.

* * * * *